US005573557A

United States Patent [19]

Thünker et al.

[11] Patent Number: 5,573,557

[45] Date of Patent: Nov. 12, 1996

[54] DEVICE FOR ADDING ADDITIVES TO LIQUID FUELS IN THE FUEL STREAM

[75] Inventors: Walter Thünker, Bottrop; Gabriele Lohmann, Lünen; Arnim Marschewski, Gelsenkirchen, all of Germany

[73] Assignee: Chemische Betriebe Pluto GmbH, Herne, Germany

[21] Appl. No.: 313,812

[22] Filed: Sep. 28, 1994

[30] Foreign Application Priority Data

Sep. 28, 1993 [DE] Germany ..... 43 32 933.0

[51] Int. Cl.[6] ..... C10L 1/30; C10L 5/00

[52] U.S. Cl. ..... 44/639; 44/530; 123/1 A

[58] Field of Search ..... 44/639, 530; 123/1 A

[56] References Cited

U.S. PATENT DOCUMENTS 2,955,028 10/1960 Bevans ..... 44/639
4,389,220 6/1983 Kracklauer ..... 123/1 A
5,059,217 10/1991 Arroyo et al. ..... 44/639
5,299,746 4/1994 Thuenker et al. ..... 44/639

*Primary Examiner*—Margaret Medley

*Attorney, Agent, or Firm*—Antonelli, Terry, Stout & Kraus

[57] ABSTRACT

A device as described for direct addition of additive solids to liquid fuels, which solids are soluble in the fuel. For adding solids to fuel directly in the line leading to the combustion chamber or engine, the device includes a hollow body at least partially filled with the solid, whose lengthwise axis is at an angle α of 130° to 170° to the inflowing fuel and whose lower end, irrigated by inflowing fuel, has at least one opening through which the fuel can enter and leave the hollow body.

10 Claims, 2 Drawing Sheets

α
1
2
3
4
5
6

DEVICE FOR ADDING ADDITIVES TO LIQUID FUELS IN THE FUEL STREAM

FIELD OF INVENTION

This invention relates to a device for direct addition of additives to liquid fuels, said additives containing solids that are soluble in the fuel, as well as a method for using the device.

BACKGROUND OF THE INVENTION

The advantages of adding additives to fuel, especially improvement or intensification of the combustion of the fuel, have been known to the individual skilled in the art for a long time. This applies both to firing systems operated with liquid fuels and to internal combustion engines, for example in motor vehicles.

One very effective and toxicologically harmless solid additive is ferrocene (see German patent DE 25 02 307). Further advantages of fuels containing ferrocene, especially reduction of fuel consumption and exhaust pollution as well as removal or reduction of deposits containing carbon, have also been described in GB 1,477,806, U.S. Pat. No. 4,389,220, DE 3 801 947, and DE 3 715 473.

In both of the latter two publications it is proposed either to add the additive (ferrocene) to the fuel directly in the corresponding concentration of the amounts recommended therein, with mixing, or to prepare a concentrate of dissolved ferrocene and then to add the required volume to the fuel to achieve the desired ferrocene concentration.

EP 0 334 248 proposes addition of ferrocene as an additive to engine lubricating oil for Diesel engines as an advantageous alternative to adding an additive to the Diesel fuel or to an additional dispensing device.

SUMMARY OF THE INVENTION

A goal of this invention is to provide a device that makes it possible to add a solid as an additive to fuels so that the solid additive can be added to any fuel not when the fuel is manufactured or delivered and not even during its final storage, but directly in the line leading to a combustion chamber or to an internal combustion engine. In addition, an associated method for direct addition of a solid additive to liquid fuels is provided by the invention.

This goal is achieved according to the invention by a device for direct addition of solids as an additive to liquid fuels, said solids being soluble in the fuel, the device comprising a housing, a hollow body at least partially filled with the solid extending into the housing, the hollow body having a lengthwise axis that is at an angle $\alpha$ of 130° to 170°, in particular of 135° to 165°, to a stream of inflowing fuel entering the housing and a lower end of the hollow body being irrigated by the inflowing fuel having at least one opening through which the fuel can enter and leave the hollow body.

With the aid of this device it is possible to add additives to the fuel as it flows through a fuel line to the combustion chamber or to the engine, thus achieving the advantages referred to at the outset, namely reducing consumption, intensifying combustion, and reducing pollutants. One important advantage is the simple procedure to be followed by the operator of the device, since for the operator, with the exception of the occasional topping up with the solid material, there are no changes to the usual handling of his system or engine.

DETAILED DESCRIPTION OF THE INVENTION

Figure 1:
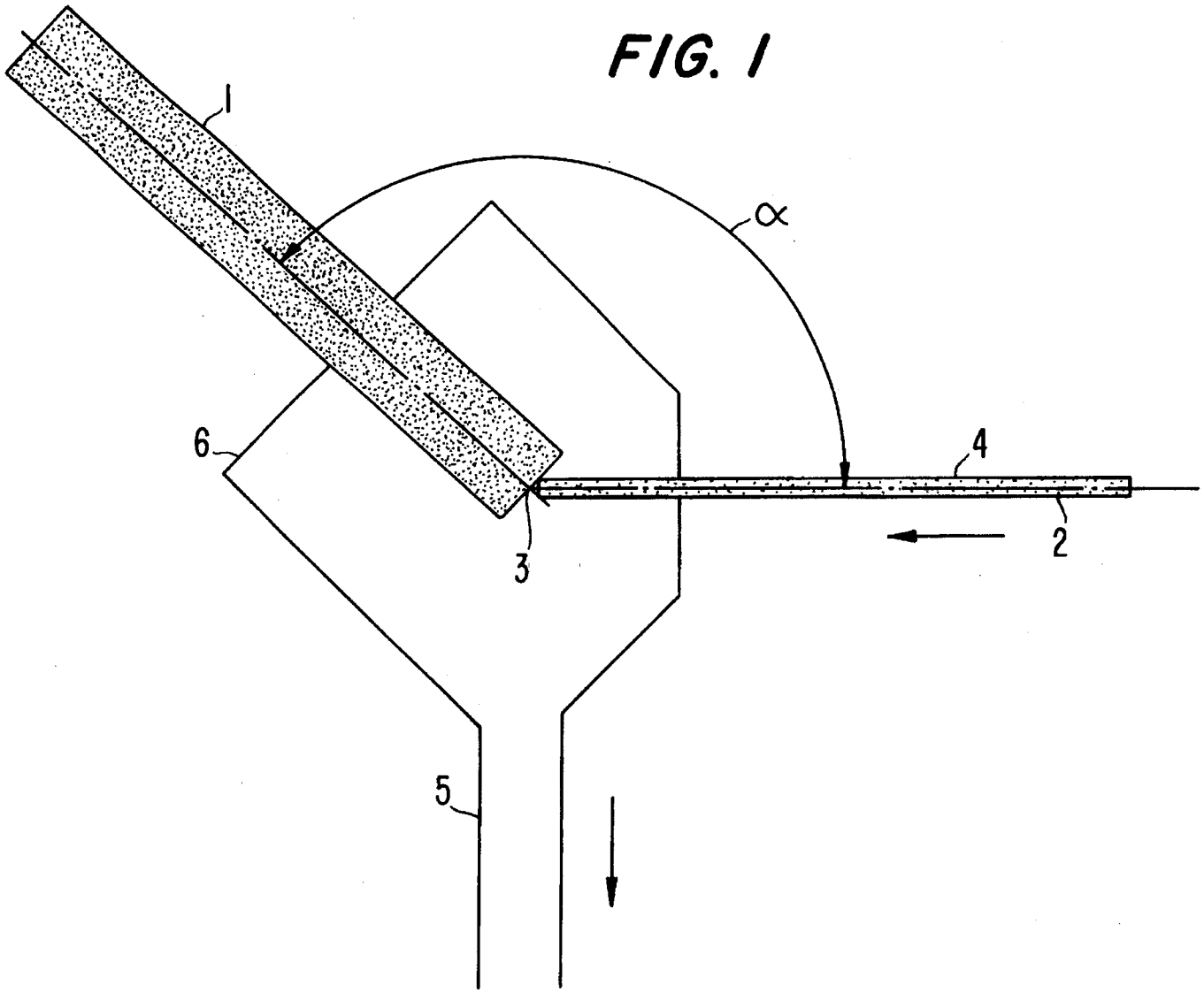
FIG. 1 is a schematic view of one embodiment of the device of the invention wherein the fuel containing additive is directed downwardly.

Preferably, the hollow body is designed to be rotationally symmetric about its lengthwise axis, i.e. it is cylindrical. The lower end of such a cylindrical body can be made flat or planar. This flat end of the cylinder has at least one opening through which the fuel can enter and exit. This end can, for example, be in the form of a lid with a screw closure interchangeably mounted at the lower end of the cylinder. If necessary, a choice may be made at this point between different lids with different numbers of openings and different opening sizes corresponding to the additive problem to be solved. However, the lower end of the hollow body can be in the shape of a segment of a sphere, i.e. hemispherical. This design too can be formed, having regard to interchangeability and the number of openings, just like the flat design. The number and size of the openings depends among other things on the type of fuel and solid additive, temperature, and desired additive concentration and in the case of doubt may be determined by simple tests. Generally the openings are circular in shape (bores). The openings may be smaller than the particles of solid material added. It may also be preferable to provide these openings additionally with a close-mesh network, screen, or grid so that no larger solid particles can be swept out of the hollow body via the opening. It has proven advantageous for the solid material to be in the form of pellets. This facilitates refilling the hollow body, in addition to which this shape of the solid material ensures sufficiently large spaces are left in the lower part of the hollow body which can be filled by the inflowing fuel. The pellets used preferably are spherically shaped and have a diameter of 1 to 10 mm, in particular 4 to 6 mm. Other shapes for the solid material such as tablets or tiny rods may be appropriate. They are usually what are known as molded bodies.

As already mentioned at the outset, ferrocene is an especially effective additive. The device according to the invention is also especially suitable for the use of ferrocene as the solid additive. This is particularly true when the ferrocene, as described above, is in the form of spherical pellets that preferably have a diameter of about 5 mm. Depending on the diameter of the pellets, the diameter of the openings is likewise in the range of 1 to 10 mm. A range of 3 to 6 mm is preferred.

Preferably the hollow body can be filled repeatedly with solid material. For this purpose it may be advantageous to open the top end of the hollow body and close it again. This can be done for example with a screw or threaded closure lid.

The end of the fuel line through which the fuel is fed to the lower end of the hollow body is at a distance from the body that depends on the outflow speed of the fuel or the pressure. However, it must be ensured that the fuel line is located far enough from the hollow body that its lower end is irrigated by the inflowing fuel. In case of doubt, this can be accomplished by simple testing. The distance is usually a few millimeters. The fuel irrigating the lower end of the hollow body usually drips or flows freely away from the lower end of the hollow body, is collected, and is conducted onward through a line in the direction of the engine or combustion chamber.

The fuel line is usually also a cylindrically shaped body. Angle α is formed by the center axis of the hollow body filled with solid material and that of the fuel stream or fuel line (see FIG. 1). This angle is preferably about 150°. Preferably the two above-mentioned center axes that form the angle α intersect exactly at the lower end of the filled hollow body. At this point it is also preferable to have an opening centered on the center axis of the filled hollow body.

The device according to the invention is preferably an integral component of a fuel supply system and is usually between the tank and the combustion chamber or engine. The system is preferably closed so that no fuel and no fuel fumes can escape outside. Such a closure can be in the form of a surrounding housing 6. The shape of the housing is of less importance. The housing is preferably designed so that it also serves to hold at least end portions of the hollow body and the fuel line 4, thus also permanently establishing the angle α.

The device according to the invention and the method according to the invention are particularly applicable to motor vehicles with internal combustion engines. However, stationery engines such as those used to drive compressors or electrical generators are also a preferred area of application. In a passenger car, such a device has the following approximate dimensions:

Inside diameter of fuel line: 4 to 8 mm

Inside diameter of hollow body 1: 20 to 30 mm.

The invention also relates to a method for direct addition of additives to liquid fuels using solid materials soluble in the fuel, characterized in that one end, provided with at least one opening, of a hollow body at least partially filled by fuel is irrigated with inflowing fuel. With this method, it is preferable for the device according to the invention to be incorporated into one of the designs described.

FIG. 1 is a diagram in schematic form of one embodiment of the device according to the invention. A stream of fuel 2 is conducted through a fuel line 4 to the lower end of hollow body 1. The center axis of the hollow body and the center axis the fuel line or fuel stream form an angle of approximately 140°. At the intersection of the two center axes, an opening 3 is present at the lower end of the hollow body. The solid material is contained in the hollow body. The fuel irrigates the lower end of the hollow body and passes in and out through the opening in the body. The outflowing fuel containing additive is captured and conducted through a header 5 in the direction of a combustion chamber or engine. This header preferably leads downward but could also lead off to the side for example. A housing 6 seals off the lower end of the hollow body and the discharge end of fuel line 4 hermetically from escape of fuel or fuel fumes to the environment and is connected to header 5.

Figure 2:
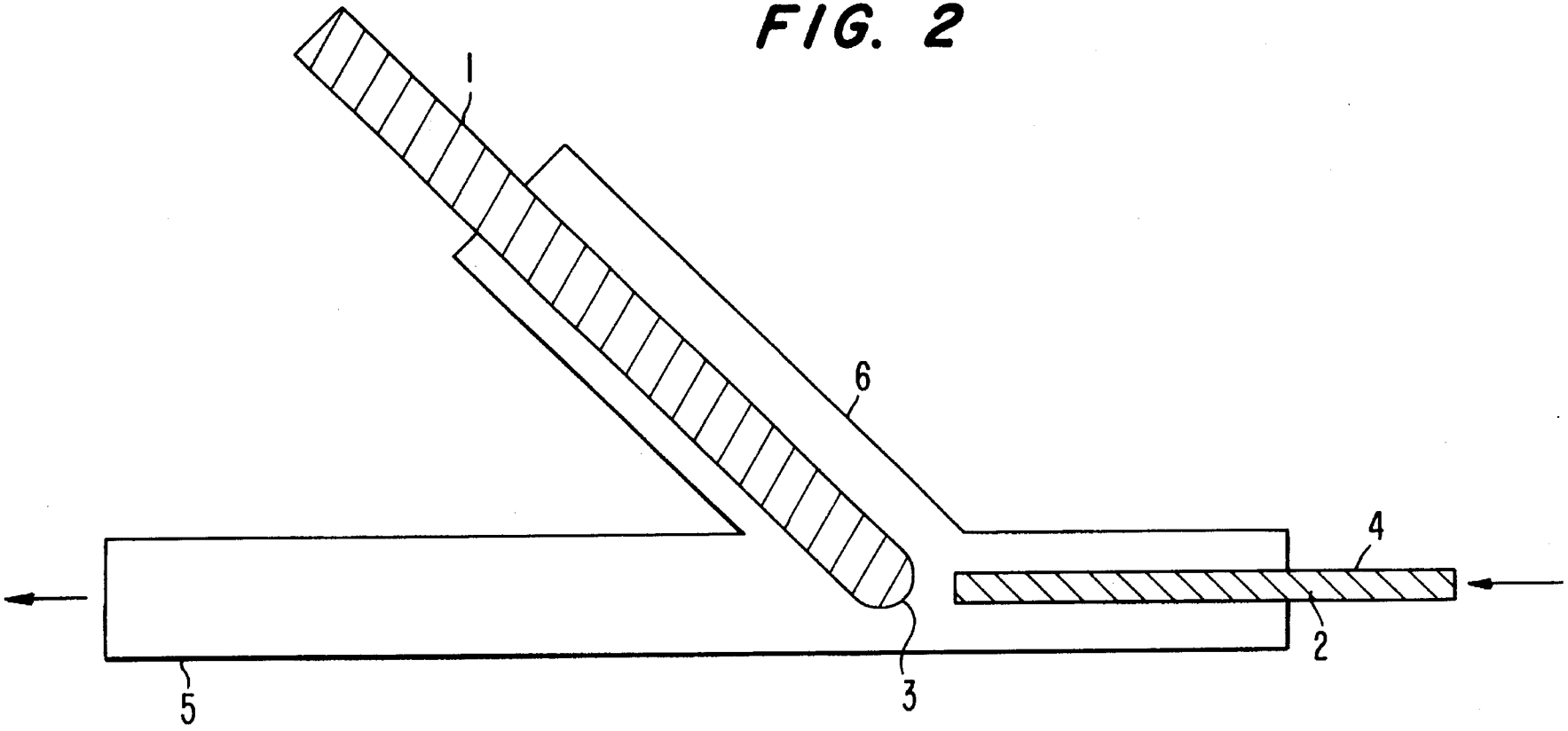
FIG. 2 is a schematic view of another embodiment of the device wherein the fuel containing additive is directed to the side of the device.

FIG. 2 shows a similar arrangement to the embodiment of FIG. 1 but with a header 5 leading to the left side and with a hemispherical lower end of hollow body 1. This arrangement can also advantageously be rotated or tilted slightly to the left so that the fuel with its additive is better able to run out through the header 5. The volumetric dimensions of a housing of a device as shown in FIG. 2 are a horizontal cylindrical part having a length of 400 mm and an inside diameter of 50 mm and an upper cylindrical branch with a length of 270 mm and an inside diameter of 30 mm.

The essence of the invention will be described in greater detail hereinafter with the aid of several examples. An experimental setup was used, corresponding essentially to the device shown in FIG. 1. Here, a commercial Diesel fuel from a fuel tank was pumped through this device at the rate of 10 l/h. The device consisted of a cylindrical hollow body (as a tubular insert 1) with an inside diameter of 22 mm and a central bore at the lower end, said body being filled with ferrocene pellets as well as of the incoming and outgoing fuel lines and of the surrounding housing. The inside diameter of the incoming fuel line is 4.5 mm and the minimum distance between the lower end of the insert and the ingoing fuel line 4 is 1.5 mm. The dissolved quantity of ferrocene is determined by weighing from time to time. The insert was given ends of various geometric shapes (hemispherical and flat). The size of the single opening or bore was also varied (3, 4, and 6 mm diameters). Each experiment was run for 500 hours. The additive used was ferrocene spherical pellets 5 mm in diameter. When the opening was 4 and 6 mm in diameter, the experiments were broken off since the results were too scattered and reproducibility could not be achieved. The reason for this is that most of the pellets did not dissolve in the end of the insert but were flushed out of it. Of the various angles used, 150° resulted in a maximum rate of addition. The maximum linearity and reproducibility were achieved with a hemispherical end on the insert. The results of the experiments are given in the tables below. The quality of the additive addition was determined by the linearity of the graph of time versus quantity of additive dissolved with the aid of linear regression. The closer the regression coefficient noted was to 1, the better the linearity.

Example 1

Lower end of hollow body: flat; central bore 3 mm; Angle α: 165°

| Time (h) | Quantity dissolved (g) | Additive (ppm) |
|---|---|---|
| 0,00 | 0,00 | 0,0 |
| 8,00 | 0,26 | 3,9 |
| 24,00 | 1,00 | 5,1 |
| 47,25 | 1,65 | 4,3 |
| 90,00 | 3,36 | 4,6 |
| 95,00 | 3,69 | 4,7 |
| 112,00 | 4,95 | 5,4 |
| 123,50 | 5,52 | 5,5 |
| 143,00 | 6,35 | 5,4 |
| 168,00 | 7,19 | 5,2 |
| 190,00 | 8,47 | 5,4 |
| 210,50 | 10,25 | 5,9 |
| 237,75 | 11,40 | 5,8 |
| 280,25 | 13,54 | 5,9 |
| 297,00 | 14,48 | 5,9 |
| 318,50 | 15,74 | 6,0 |
| 340,25 | 17,32 | 6,2 |
| 361,00 | 17,97 | 6,1 |
| 384,00 | 19,03 | 6,0 |
| 401,25 | 20,41 | 6,2 |
| 421,00 | 21,74 | 6,3 |
| 442,00 | 22,30 | 6,2 |
| 463,75 | 23,37 | 6,1 |
| 482,00 | 24,70 | 6,3 |
| 500,00 | 26,06 | 6,4 |

Regression coefficient: 0.999

Example 2

Lower end of hollow body: flat; central bore: 3 mm; Angle α: 150°

| Time (h) | Quantity dissolved (g) | Additive (ppm) |
|---|---|---|
| 0,00 | 0,00 | 0,00 |
| 6,00 | 1,62 | 32,9 |
| 25,50 | 7,20 | 34,4 |
| 48,00 | 11,65 | 29,6 |
| 72,25 | 16,11 | 27,2 |
| 93,00 | 21,92 | 28,7 |
| 109,75 | 26,88 | 29,9 |
| 120,00 | 29,01 | 29,5 |
| 143,00 | 34,49 | 29,4 |
| 169,15 | 41,19 | 29,7 |
| 193,00 | 49,77 | 31,5 |
| 211,00 | 54,12 | 31,3 |
| 240,50 | 60,80 | 30,8 |
| 256,50 | 64,83 | 30,8 |
| 282,50 | 75,23 | 32,5 |
| 300,00 | 78,97 | 32,1 |
| 322,25 | 84,26 | 31,9 |
| 339,00 | 88,09 | 31,7 |
| 356,00 | 92,29 | 31,6 |
| 380,75 | 96,25 | 30,8 |
| 402,00 | 99,65 | 30,2 |
| 418,25 | 103,49 | 30,2 |
| 440,00 | 108,69 | 30,1 |
| 463,50 | 117,15 | 30,8 |
| 481,50 | 121,69 | 30,8 |
| 500,00 | 126,44 | 30,8 |

Regression coefficient: 1.000

Example 3

Lower end of hollow body: flat; central bore: 3 mm; Angle α: 135°

| Time (h) | Quantity dissolved (g) | Additive (ppm) |
|---|---|---|
| 0,00 | 0,00 | 0,0 |
| 6,00 | 0,38 | 7,8 |
| 24,00 | 1,87 | 9,5 |
| 46,25 | 5,52 | 14,5 |
| 90,00 | 9,12 | 12,4 |
| 93,25 | 9,48 | 12,4 |
| 108,00 | 10,57 | 11,9 |
| 124,75 | 12,68 | 12,4 |
| 137,50 | 13,83 | 12,3 |
| 172,00 | 20,10 | 14,2 |
| 195,50 | 21,47 | 13,4 |
| 212,00 | 22,89 | 13,2 |
| 234,00 | 25,52 | 13,3 |
| 285,75 | 35,33 | 15,1 |
| 301,00 | 37,49 | 15,2 |
| 318,00 | 39,54 | 15,2 |
| 345,00 | 43,60 | 15,4 |
| 364,00 | 45,55 | 15,3 |
| 382,00 | 47,06 | 15,0 |
| 399,50 | 48,40 | 14,8 |
| 421,50 | 49,28 | 14,3 |
| 440,00 | 51,99 | 14,4 |
| 460,25 | 54,24 | 14,4 |
| 479,50 | 57,32 | 14,6 |
| 500,00 | 60,44 | 14,7 |

Regression coefficient: 0.998

Example 4

Lower end of hollow body: hemispherical; central bore: 3 mm; Angle α: 165°

| Time (h) | Quantity dissolved (g) | Additive (ppm) |
|---|---|---|
| 0,00 | 0,00 | 0,0 |
| 5,00 | 2,40 | 58,5 |
| 23,75 | 7,20 | 37,0 |
| 47,00 | 8,80 | 22,8 |
| 71,50 | 11,20 | 19,1 |
| 96,50 | 12,80 | 16,2 |
| 102,50 | 15,20 | 18,1 |
| 109,50 | 16,80 | 18,7 |
| 126,00 | 20,80 | 20,1 |
| 152,50 | 25,60 | 20,5 |
| 174,50 | 32,80 | 22,9 |
| 198,50 | 37,60 | 23,1 |
| 224,00 | 44,00 | 24,0 |
| 272,00 | 56,80 | 25,5 |
| 293,50 | 60,80 | 25,3 |
| 320,00 | 63,20 | 24,1 |
| 369,50 | 71,20 | 23,5 |
| 393,75 | 86,40 | 26,8 |
| 417,50 | 90,40 | 26,4 |
| 440,50 | 92,80 | 25,7 |
| 466,00 | 96,80 | 25,3 |
| 485,50 | 99,20 | 24,9 |
| 500,00 | 103,20 | 25,2 |

Regression coefficient: 0.992

Example 5

Lower end of hollow body: hemispherical; central bore: 3 mm; Angle α: 150°

| Time (h) | Quantity dissolved (g) | Additive (ppm) |
|---|---|---|
| 0,00 | 0,00 | 0,0 |
| 17,50 | 6,60 | 46,0 |
| 23,50 | 9,90 | 51,4 |
| 45,75 | 18,90 | 50,4 |
| 69,75 | 26,70 | 46,7 |
| 93,75 | 34,20 | 44,5 |
| 119,00 | 38,10 | 39,0 |
| 124,00 | 40,80 | 40,1 |
| 143,00 | 48,30 | 41,2 |
| 149,00 | 50,10 | 41,0 |
| 191,00 | 63,00 | 40,2 |
| 214,50 | 71,10 | 40,4 |
| 219,50 | 73,50 | 40,8 |
| 226,00 | 74,70 | 40,3 |
| 241,50 | 81,60 | 41,2 |
| 246,00 | 82,50 | 40,9 |
| 266,00 | 90,00 | 41,3 |
| 289,25 | 98,10 | 41,4 |
| 313,25 | 106,50 | 41,5 |
| 317,25 | 107,10 | 41,2 |
| 333,75 | 112,80 | 41,2 |
| 359,25 | 120,30 | 40,8 |
| 386,50 | 129,00 | 40,7 |
| 403,50 | 138,90 | 42,0 |
| 430,00 | 146,10 | 41,4 |
| 438,00 | 147,30 | 41,0 |
| 450,75 | 153,90 | 41,6 |
| 475,50 | 161,70 | 41,5 |
| 500,00 | 169,20 | 41,3 |

Regression coefficient: 0.999

Example 6

Lower end of hollow body: hemispherical; central bore: 3 mm; Angle α: 135°

| Time (h) | Quantity dissolved (g) | Additive (ppm) |
|---|---|---|
| 0,00 | 0,00 | 0,0 |
| 5,25 | 0,80 | 18,6 |
| 24,00 | 4,80 | 24,4 |
| 46,00 | 12,00 | 31,8 |
| 70,00 | 17,60 | 30,7 |
| 93,00 | 22,40 | 29,4 |
| 101,00 | 24,80 | 29,9 |
| 108,00 | 27,20 | 30,7 |
| 124,00 | 31,20 | 30,7 |
| 132,17 | 33,60 | 31,0 |
| 149,00 | 37,60 | 30,8 |
| 155,50 | 40,00 | 31,4 |
| 199,00 | 50,40 | 30,9 |
| 206,00 | 52,00 | 30,8 |
| 211,00 | 54,40 | 31,4 |
| 229,75 | 58,40 | 31,0 |
| 253,00 | 61,60 | 29,7 |
| 276,50 | 65,60 | 28,9 |
| 301,50 | 68,80 | 27,8 |
| 307,50 | 71,20 | 28,2 |
| 314,50 | 73,60 | 28,5 |
| 331,00 | 77,60 | 28,6 |
| 355,00 | 82,40 | 28,3 |
| 379,50 | 89,60 | 28,8 |
| 403,50 | 94,40 | 28,5 |
| 429,00 | 100,80 | 28,7 |
| 477,00 | 113,60 | 29,0 |
| 500,00 | 118,40 | 28,9 |

Regression coefficient: 0.997

What is claimed is:

1. A device in a part of a fuel line system of an automobile for direct addition of additive solids to liquid fuel wherein the solids are soluble in the fuel, which comprises a housing, a hollow body at least partially filled with particles of the fuel-soluble solids located at least partially in the housing, a fuel line extending into said housing, said hollow body having a lengthwise axis that is at an angle α of 130° to 170° to a stream of inflowing fuel introduced by an end of said fuel line and a lower end of the body being irrigated by inflowing fuel and having at least one opening through which the fuel can enter and leave the hollow body to enable the particles of the solids to be dissolved in the inflowing fuel, and a header connected to the housing for conducting the additive-containing fuel from the housing to an end of a fuel line connected to an engine; said at least one opening being smaller than sizes of the particles and acting to prevent the particles from being removed from the hollow body.

2. A device according to claim 1, wherein by the hollow body having rotational symmetry about its lengthwise axis.

3. A device according to claim 1, wherein the lower end of the hollow body has a planar shape.

4. A device according to claim 2, wherein the lower end of the hollow body has a planar shape.

5. A device according to claim 1, wherein the lower end of the hollow body has a shape of a segment of a sphere to provide a hemispherical end portion.

6. A device according to claim 2, wherein the lower end of the hollow body has a shape of a segment of a sphere to provide a hemispherical end portion.

7. A device according to claim 1, wherein the particles comprise pellets.

8. A device according to claim 1, wherein the hollow body has an upper end that is openable and reclosable for adding solids thereto.

9. A device according to claim 1, wherein the end of said fuel line through which the incoming fuel is introduced into the housing is spaced from the lower end of the hollow body to form the stream of inflowing fuel that passes through the at least one opening into the hollow body.

10. A device according to claim 1, wherein the particles comprise spherically-shaped pellets having a diameter of from 1 to 10 mm.

* * * * *